United States Patent [19]
Maucher et al.
[11] 4,258,610
[45] Mar. 31, 1981

[54] CONTROL APPARATUS FOR A HYDRAULIC POWER CONSUMER

[75] Inventors: Edmund Maucher, Wooster, Ohio; Friedrich-Wilhelm Höfer, Ditzingen-Hirschlanden; Günther Schwerin, Möglingen, both of Fed. Rep. of Germany

[73] Assignee: Robert Bosch GmbH, Stuttgart, Fed. Rep. of Germany

[21] Appl. No.: 930,982

[22] Filed: Aug. 4, 1978 (Under 37 CFR 1.47)

[30] Foreign Application Priority Data

Aug. 6, 1977 [DE] Fed. Rep. of Germany ..... 2735558

[51] Int. Cl.[3] ..... F15B 11/08; F15B 13/042

[52] U.S. Cl. ..... 91/445; 91/447; 91/448; 137/596.12; 137/596.16

[58] Field of Search ..... 91/445, 447, 446, 448, 91/459, 461, 420; 137/596.12, 596.16, 596.14, 625.48; 60/494

[56] References Cited

U.S. PATENT DOCUMENTS

| | | | |
|---|---|---|---|
| 3,411,521 | 11/1968 | Johnson | 91/420 X |
| 3,537,259 | 11/1970 | Gordon et al. | 60/471 |
| 3,613,509 | 10/1971 | Flaschar et al. | 137/596.16 X |
| 3,648,570 | 3/1972 | Koch | 92/60 |
| 3,906,838 | 9/1975 | Hofer | 91/459 X |
| 3,949,645 | 4/1976 | Masclet | 91/459 |
| 3,980,000 | 9/1976 | Iijima et al. | 137/596.14 X |
| 4,052,930 | 10/1977 | Hiramatsu et al. | 137/596.12 X |
| 4,088,151 | 5/1978 | Schurger | 91/447 X |

FOREIGN PATENT DOCUMENTS

| | | | |
|---|---|---|---|
| 1929482 | 2/1970 | Fed. Rep. of Germany | 91/447 |
| 2231910 | 6/1973 | France | 91/447 |

*Primary Examiner*—Irwin C. Cohen
*Attorney, Agent, or Firm*—Michael J. Striker

[57] ABSTRACT

A control apparatus for a hydraulic power consumer, particularly in agricultural machines, has a pressure medium reservoir which is connected with a member for supplying pressure medium from the reservoir to the user to thereby move the latter from a stationary position. This member is subject to pressure oscillations which result from a pressure difference which is created in this chamber on displacing of the consumer from the stationary or neutral position. In order to eliminate undesirable oscillations of the user on displacement of the latter from the stationary position the arrangement is provided with a member for damping these pressure oscillations.

16 Claims, 4 Drawing Figures

10
11
12
13
14
15
15'
16
17
18
19
21
22
23
24
25
26
27
28
29
31
32
33
34
35
36
37
38
39
41
42
43
44
45
46
47
48
49
50
51
52
53
54
55
56
57
58
59
61
62
63
64
65
66
67
68
69
71
72
73
74
75
76
77
78
79
80
81
82
83
84
85
86
87
88
89
90
91
92
93
94
95
96
97
98
99
101

21
22
25
26
27
28
42
13
59
61
97

CONTROL APPARATUS FOR A HYDRAULIC POWER CONSUMER

BACKGROUND OF THE INVENTION

The invention relates to hydraulic control arrangements. More particularly, this invention concerns a control apparatus for a hydraulic power consumer, particularly in mobile agricultural machines.

Conventionally (see for example German Offenlegungsschrift No. 22 32 857) such an arrangement includes a reversing valve actuated by a magnetic valve and operative to supply pressure medium to a consumer. The reversing valve is provided with a first relief valve for regulating pressure medium flow in this valve. The reversing valve is further provided with a piston which has a precise control chamfer. The piston bounds in this valve a control chamber which is operatively connected with the magnetic valve, through another relief valve. The other relief valve is operative to damping the pressure oscillations in the user resulted when the consumer or user moves from a stationary position.

A shortcoming of such a construction resides in the fact that the desirable damping function of this arrangement occurs too late; i.e., the relief valve reduces the pressure medium flow only when the pressure in an inlet chamber of this arrangement (resulting from the force of a spring which actuates the piston) exceeds that which is exercised on the user from an outside load. In such a case the piston is urged to move into its end position, so that the precise control chamfer cannot operate efficiently with regard to dampening the user's oscillations.

Another shortcoming of such a construction resides in providing two different valves which are necessary to alternately supply and withdraw the pressure medium to and from the user, respectively. That results in relatively high expenses and makes the possibility of leakage in such a system very likely.

Furthermore, the damping means in such a construction have to be installed immediately on the valve which operates for lowering the user. This fact leads to a situation where, if the load on the user is small, the lowering action can be carried out only slowly, which is obviously disadvantageous for the productivity of such an arrangement.

Also, it is to be understood that leakage of the pressure medium when the user is in its stationary position or is being lowered, leads to very undesirable consequences.

Utilization of two different servovalves raises the expense of such an arrangement. Besides that, the provision of the second valve for controlling the operation of the user creates a danger of malfunction of the user.

SUMMARY OF THE INVENTION

It is an object of the present invention to overcome the disadvantage of the prior art arrangements.

Pursuant to this object and others which will become apparent hereafter, a control arrangement is provided with a pressure medium reservoir, which is connected with means for supplying pressure medium from the reservoir to the consumer or user to thereby move the latter from a stationary position. These means are subject to pressure oscillations which result from a pressure difference in these means. This pressure difference is created upon displacement of the user from the stationary position. The control arrangement is provided with means for damping the pressure oscillations in the supplying means to thereby eliminate the undesirable oscillations of the user on displacement of the latter from the stationary position.

The control arrangement is further provided with means for withdrawing the pressure medium from the user, to thereby move the latter in a direction which is opposite to the one in which the user moves in response to supplying of the pressure medium to the user.

Another advantageous feature of the present invention resides in providing a single valve unit operative for both communicating and discommunicating the user with the supplying means and with the withdrawing means to thereby alternatively move the user in the respective directions.

Due to the single valve unit the danger of a situation where multifunctions can occur, is eliminated, and also the efficiency of the damping action is considerably improved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
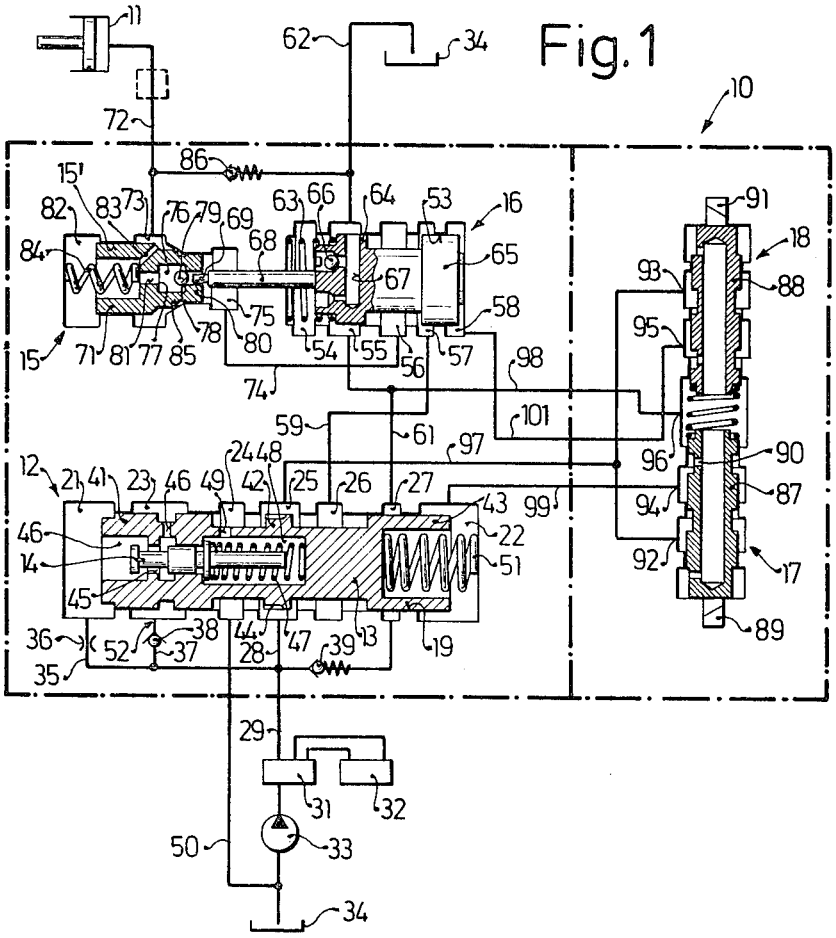
FIG. 1 is a sectional view, showing a control arrangement according to the invention, in a stationary position.

Referring now to the drawings and first to FIG. 1 thereof, it may be seen that the reference numeral 10 designates a control apparatus for a hydraulic power consumer 11, for example a power lift for a tractor.

The control arrangement 10 is provided with a housing (not shown) having a reversing valve unit 12 provided with a bore 19 for slidably receiving therein a control piston 13, a pilot valve unit 16 provided with a bore 53 for slidably receiving therein a piston 65, a check valve unit 15 provided with a bore 15' for slidably receiving therein a piston 71, and two similar preliminary control valve units 17 and 18 connected to the valve units 12 and 16, respectively.

The bore 19 of the valve 12 is provided on its respective ends with first and second control chambers 21 and 22 correspondingly. Between these chambers there are located a third chamber 23 adjacent to and connected with the first control chamber 21, an outlet chamber 24, an inlet chamber 25, an intermediate chamber 26 and a relieving chamber 27. The inlet chamber 25 is connected to an inlet passage 28 and further to a conduit 29 and then through a multiple-way valve 31 (which is connected to another user 32) the inlet chamber 25 is connected to a pump 33, which aspirates a pressure medium, for example oil from a reservoir 34. From the inlet passage 28 a first control passage 35 through a throttle 36 leads some oil, without interposition, in the first control chamber 21.

The first control passage 35 is further connected, through a control channel 37 with the third chamber 23. The channel 37 is provided with a relief valve 38 which is operative to regulate the dicharging flow of oil from the third chamber 23. The throttle 36 and the relief valve 38 are parallel to each other. The inlet passage 28 is further connected through a relief valve 39 with the relieving chamber 27. The piston 13 is provided with three piston-portions 41, 42 and 43. The second portion 42 has a precision control chamfer 44. The piston-portion 41, which is the first adjacent to the first control chamber 21, is provided with an inner longitudinal passage 45 which is coaxial to the axis of the piston 13. The passage 45 is operative to slidably receive a control plug 14. A recess 46, which is provided in the piston-portion 41, and the longitudinal passage 45 renders it possible to provide a communication between the first control chamber 21 and the third chamber 23. The communication can be interrupted by a control plug 14. The control plug 14 is held in a shown neutral position by a spring 47. The spring 47 is installed in a recess 48, which is provided in the piston 13. The recess 48 is empty due to a passage 49 which connects the recess 48 with the outlet chamber 24. A spring 51 is inserted in the second control chamber 22 and this spring 51 urges the piston 13 in direction towards the first chamber 21.

The relief valve 38 is connected with the third chamber 23 by a control passage 52 extending parallel to the first control passage 35 which connects the first chamber 21 with the inlet channel 25. An outlet passage 50 connects the outlet chamber 24 with the reservoir 34.

The bore 53 of the valve 16 is provided with a third control chamber 54, an outlet chamber 55, an intermediate chamber 56, an inlet chamber 57 and a fourth control chamber 58. The inlet chamber 57 is connected through a passage 59 with the intermediate chamber 26 of the valve 12. The relieving chamber 27 is connected with the outlet chamber 55 through a relieving passage 61. The outlet chamber 55 has a connection with the reservoir 34 through outlet passage 62. A spring 63 is inserted in the control chamber 54 so as to urge the piston of valve 16 in direction towards the fourth control chamber 58. The piston of valve 16 correspondingly is provided with a first piston-portion 64 in the chamber 54, and a second piston portion 65 in the chamber 58. In the shown position of the valve 16 the piston-portion 64 provides not only the connection between the third control chamber 54 with the outlet chamber 55 but also is provided with an additional connection between these two chambers. This additional connection includes a circumferential recess connecting with the third control chamber, which is coaxial with the axis of the piston 16, and a passage 67 which has an axis substantially transverse to the axis of the piston of valve 16. The passage 67 connects the circumferential recess with the chamber 55. In the recess there is inserted a relief valve 66, which is operative to regulate the pressure in both chambers. The first piston portion 64 is provided with a rod 68 in direction towards the valve 15. At the end of the rod 68 their is provided a pin 69.

The valve unit 15 has a valve member 71 which is slidably mounted in the bore 15'. The bore 15' is provided with a fifth control chamber 82, a communicating chamber 73 connected to a passage 72 which leads to the user 11 and a sixth control chamber 75 which is connected to the second valve unit 16. The fifth control chamber 82 is connected to the communicating chamber 73. The valve member 71 is hollow and has a recess 76 which is provided with a first valve seat 78 and a second valve seat 79 axially spaced from the first valve seat 78. The first and the second valve seats are operative to closely receive a closing member, for example, a ball 79. The recess 76 is connected through an axial passage 81 at one side with the sixth control chamber 75 and at the other side with the fifth control chamber 82. The fifth control chamber 82 is connected through a throttle bore 83 with the communicating chamber 73. A spring 84 is installed in the chamber 82 so as to urge the valve member 71 against a valve seat 85 so that the pin 69 of the rod 68 projects in the axial passage 81 which is further provided with a precision control chamber 80. The user passage 72 is connected to the outlet conduit 62 through a relief valve 86.

The arrangement is further provided with two similar three-way two-position valves 17 and 18. These valves are provided with spring-loaded control plugs or slides 87 and 88 respectively. Each of the plugs is actuated by a separate magnet 89 and 91, respectively. Each of the valves 17 and 18 is provided with separate inlet conduits 92 and 93, control conduits 94 and 95 and a common outlet conduit 96. Both inlet conduits 92, 93 are connected with the inlet chamber 25 through a conduit 97. The outlet conduit 96 is connected to the outlet chamber 55 through a conduit 98. The control conduit 94 of the first valve unit 17 is connected through a conduit 99 with the second control chamber 22 of the valve unit 12 and the control conduit 95 of the second valve 18 is connected through a conduit 101 with the fourth control chamber 58 of the valve unit 16.

The function of the control arrangement 110 is as follows:

In FIG. 1 the control arrangement 10 is shown in its stationary or neutral position. Neither of the valve units 17 and 18 operates. The second control chamber 22 of the valve unit 12 and the fourth control chamber 58 of the valve unit 16 are connected through the valve units 17 and 18 correspondingly with the conduit 98 and further with the outlet chamber 55 and outlet passage 62 with the reservoir 34. The spring 63 holds the piston of valve 16 in the shown position, and the pressure in the power lift 11 urges the valve member 71 into engagement with the valve seat 85. The ball 79 is on the second valve seat 78 which fact renders it possible to hydraulically block up the power lift 11. The relief valve 18 protects the power lift 11 from the excess of the pressure therein, which can result for example from forces created during movement of the vehicle over a ridge in the ground. The oil aspirated from the reservoir 34 by the pump 33 flows through not actuated open multiple valve 31, the inlet chamber 25, the outlet chamber 24 and the outlet conduit 50 back to the reservoir 34. During the oil flows from the inlet chamber 25 into the outlet chamber 24 a drop in pressure occurs, which is determined by the spring 51. This low, neutral pressure is transmitted through the first control passage 35 also in the control chamber 21 and keeps the piston 13 against the force of the spring 51 in this neutral position so that the oil substantially without loss of the neutral pressure discharges in the reservoir 34.

The control plug 14 is actuated at one side by a pressure existing in the first control chamber 21 and at the other side by a pressure difference created from a pressure in the communicating chamber 23 which pressure urges the plug in its closed position and a pressure resulted from a force of the spring 47 which force urges the plug 14 into its open position. The control plug 14 closes the throttle 45 when the pressure on this plug is substantially less than that in the user 11. The pressure in the arrangement, especially due to the pressure oscillations on the user 11, can result in closing the inlet chamber 25. To prevent the premature closing the inlet chamber 25 the pressure medium gradually flows from the first control chamber 21 in accordance with the open control plug 14, so that the speed of the movement of the piston 13 towards the first control chamber raises gradually, not immediately, upon the displacement of the piston in the mentioned direction. If this is the case, the pressure oscillations of the user are smoothed and the user moves gradually from its stationary position in one or the opposite direction.

Figure 2:
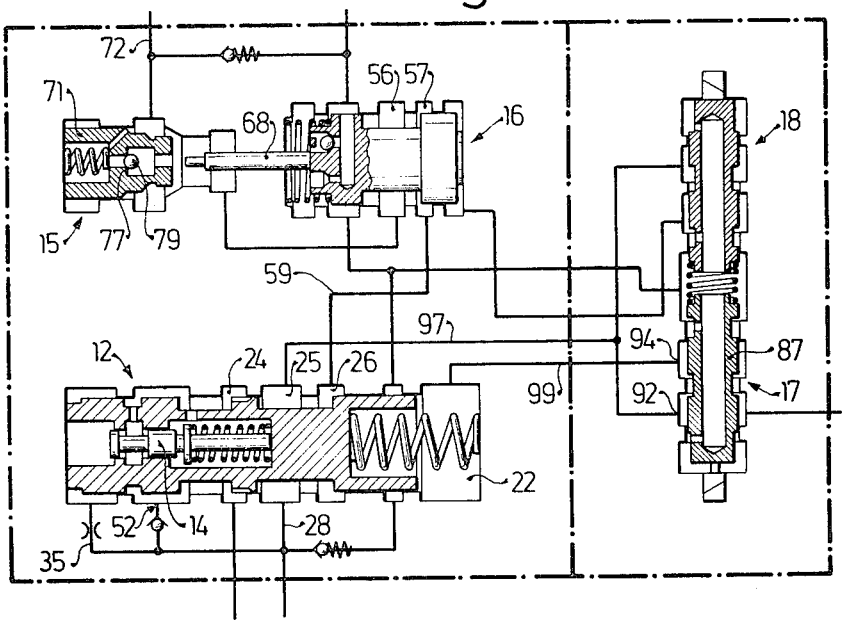
FIG. 2 is a sectional view of the control arrangement of FIG. 1, in a position corresponding to displacement of the user in one direction.

In order to lift the user 11 the first valve unit 17 is magnetically actuated. As shown in FIG. 2, the control plug 87 connects the control conduit 94 with the inlet conduit 92 and hence the second control chamber 22 with the inlet chamber 25. The pressure in the first and the second control chamber is neutral, therefore the piston 13 subjected to equal pressure from both control chambers and it will move leftwise (if viewed on FIGS. 1, 2) due to the force of the spring 51. At first the piston 13 moves very prompt, because the oil from the first control chamber 21 flows without throttling through the second control passage 52 and the control plug 14 (which is in its open position) into the inlet chamber 25 and further into the outlet chamber 24, so that up to the inlet chamber 25 the neutral pressure is effective. Should the longitudinal movement of the piston 13 start, the precision control chamfer 44 reduces the communication between the inlet chamber 25 and the outlet chamber 24. Therefore, the pressure in the inlet chamber 25 increases, thereby increasing the pressure in the chambers 21, 22 and 23. Further increments of the longitudinal movement of the piston 13 the pressure also increase correspondingly. When the pressure reaches a certain lever, where the spring 47 yields and the plug 14 as shown in FIG. 2 takes the closed position, so that the second control passage 52 is closed. In this case, the oil can flow from the first control chamber 21 only in throttled condition, through the first control passage 35. The movement of the valve unit 12 is stopped, but it moves slowly further by some distance to the left. The precision control chamfer 14 does not further close the passage between chambers 25 and 24, and the pressure in the inlet chamber 25 increases gradually. This pressure is also effective in the chamber 26 and further in the passage 59, the inlet chamber 57, the intermediate chamber 56 and the passage 74 and the sixth control chamber 75. As long as the pressure resulting from the load applied to the user 11 exceeds that in the sixth control chamber 75, the valve member 71 and the ball 79 remain in their valve seats 85 and 78 respectively. Should the pressure in the sixth control chamber 75 eventually exceed that on the user 11, then the ball 79 moves from the second valve seat 78 onto the first valve seat 77. From now on the valve unit 15 operates as a pure relief valve. The valve member 71 leaves its seat so that the oil can flow through thus created gap into the user 11. This process continues until all the oil applied by the pump 33 and flowing through the precision control chamber 44 reaches the user 11. Then, the piston 13 takes its ultimate left position as shown in FIG. 2. In order to stop the lift the magnet 89 will be deenergized so that the spring-loaded control plug 87 moves to its initial position, that is the position shown in FIG. 1 and the second control chamber 22 will then again communicate with the reservoir 34. The oil now flows from the inlet chamber 25 through the first control passage 35 (now throttling) into the first control chamber 21, thus urging the piston 13 from the position shown in FIG. 2 and correspondingly to the raising position of the user 11 rightwards against the force of the spring 51. The precision control chamfer 44 moves further so that the user 11 will be further lifted. The throttle 36 is operative in this instance only not to permit the piston 13, due to relative high pressure, immediately take its neutral position but to exercise some dampening functions. The throttle 36 creates in this so-called acceleration period of the piston 13, a sharp drop of pressure in the first control chamber 21. The pressure in this chamber which was created by the spring 51, will not be sufficient to keep the piston 14 closed. Thus the force of the spring 51 is determining for the pressure applied to the piston 14. The piston 14 then opens the communication between the first control chamber 21 and the chamber 23. This does not result in any disadvantageous consequences, since the relief valve 38 prevents unthrottled flow for the oil from the first control passage 35, into the chamber 23. During the rightward movement of the piston 13 the precision control chamfer 44 also regulates the communication between the inlet chamber 25 and the outlet chamber 24. The pressure in the system drops to such an extent that it is exceeded by the pressure in the user resulting from the forces applied to the user and as a result the ball 79 moves back onto the second valve seat 78 and the valve member 71 moves onto the seat 85. The valve unit 15 now serves as a pure relief valve. The lifting process is over and the control arrangement is again in its neutral position corresponding to that shown in FIG. 1.

Figure 3:
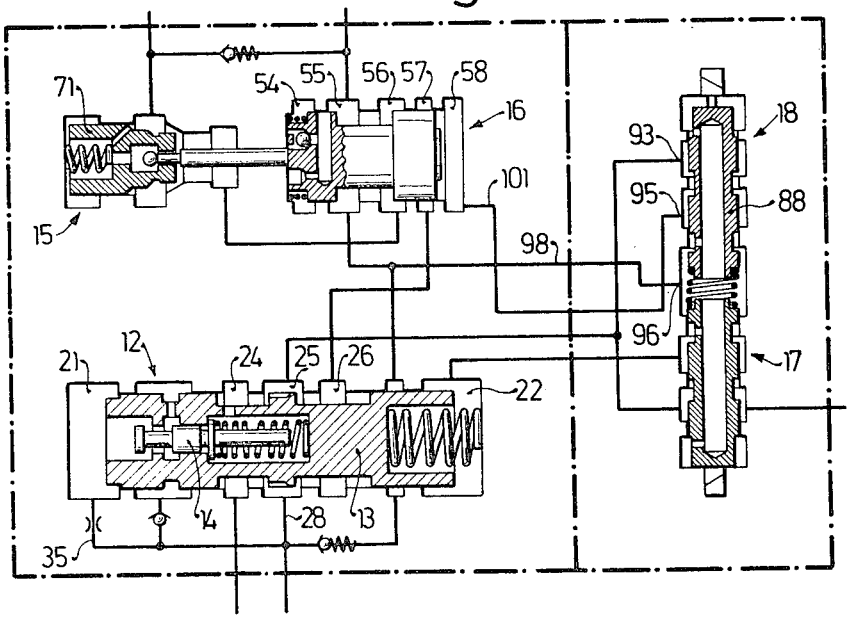
FIG. 3 is a sectional view of the control arrangement of FIG. 1 in a position corresponding to displacement of the user in an opposite direction.

In order to lower the user 11 the second valve unit 18 is magnetic actuated, thus moving the control plug 88 against the force of the spring in its second position, that is the working position as it may be seen in FIG. 3. The sixth control chamber 58 of the valve unit 16 is connected with the inlet chamber 25 through the conduit 101, the second valve unit 18, the inlet conduit 93 and the conduit 97 which is connected to the inlet chamber 25. The neutral pressure, which is now effective through all the such a communication renders it possible to move the piston 16 against the force of the spring 62 from the neutral position shown in FIG. 1 towards the third control chamber 54. The second piston-portion 65 moves toward the communication between the inlet chamber 57 and the chamber 56 and gradually opens the communication between the chamber 56 and the outlet chamber 55. In such a manner the drop of the neutral pressure will be prevented because this pressure is necessary to further function of the piston 16. During such a movement the first piston-portion 64 enters the third control chamber 54 so that the oil which was in this chamber is urged from the chamber 34 through the communication into the outlet chamber 55. During further movement of the piston 16 the rod 68 with the pin 69 comes close to the ball 79 in the valve member 71. Up to this moment the movement of the piston 16 apart from the small resistance of the spring 63, is not subjected to any other resistance. Only when the first piston-portion 64 interrupts the communication between the third control chamber 54 and the outlet chamber 55 the oil then must flow from the third control chamber 54 through the throttle of the relief valve 66 and the transverse passage 67 into the outlet chamber 55. Then, the piston 16 moves slowly leftwards and the pin 69 urges the ball 79 from the second valve seat 78, so that the corresponding lowering of the user 11 starts. An additional flow of the oil is created through the throttle passage 83, the fifth control chamber 82, the axial passage 81, the valve seats 77 and 78. This additional flow is created on the ball (moved from the second seat 78) from the user 11 in direction towards the sixth control chamber 75. This additional flow acts on the throttle passage 83 and creates there a pressure difference and hence a drop of pressure in the fifth control chamber 82. The surface of the valve member 71, which is in the chamber 73 is subjected to a load pressure which is applied leftwards and against the force of the spring 84. Therefore, the valve member 71 moves leftwards from the valve seat 85. When the valve unit 15 is open the valve member 71 and the piston 16 operates together so that the ball 79 together with the second valve seat 78 bound a throttle portion, in order to regulate an intermediate pressure which is necessary for opening of the valve member 71. Thus, to open the valve member 71 the small force of the pin 68 is sufficient. The speed of opening may be determined by a corresponding construction of the throttle relief valve 66 in the valve unit 16. The valve member 71 has a portion 80 which is received in the chamber 75. This portion is provided with a precision control groove, which renders it possible to precisely control the communication when the valve member 71 is open. FIG. 3 shows a position where the user 11 is lowered, and the piston 16 takes its ultimate working position and the valve member 71 is fully open. If such a case the oil flows from the user 11 through the valve unit 15, the conduit 74, the chamber 56, the communicating chamber 55 and the outlet passage 62 into the reservoir 34.

In order to stop the lowering the user 11 the magnet 91 is disconnected so that the control plug 88 of the second control valve 17 is urged back by a spring force into the initial position, corresponding to that shown in FIG. 1. The fourth control chamber 58 is then reconnected to the reservoir 34 through the passage 101, the conduit 95, the outlet conduit 96, the conduit 98. the outlet chamber 55 and the outlet chamber 62 which is connected to the reservoir 34. The third control chamber 54 communicates through the relief valve 66 and the transverse bore 67 with the outlet chamber 54. The spring 63 urges the piston 16 rightwards back in its initial position. This movement is accomplished quickly, because the throttle of the relief valve 66 operates to bypass the oil into the outlet chamber 55. The valve member 71 follows this movement and moves into the valve seat 85, while the ball 79 is forced by a load pressure into the second valve seat 78. The lowering process is now over and the control arrangement is in its initial position corresponding to that shown in FIG. 1.

Figure 4:
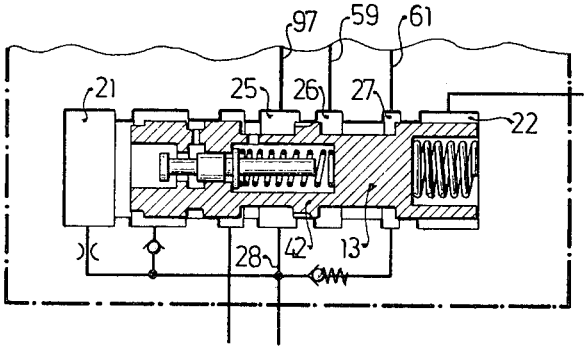
FIG. 4 is a sectional view showing a part of the control arrangement in an additional position.

Should the neutral pressure exceed the force of the spring 51 in the second control chamber 22, the piston 13 moves from the position shown in FIG. 1 rightwards against the force of the spring 51 until the end face of the piston 13 engages the opposite wall of the second control chamber 22 (FIG. 4).

In such an end position the piston portion 42 closes the communication from the inlet chamber 25 into the chamber 26. Inasmuch as the passage 97 runs from the inlet chamber 25, even in such an end position, the piston 13 can accomplish the lowering and lifting of the user 11. The oil which comes through the small gap between the piston portion and the corresponding wall of the communication flows through the relieving passage 61, the outlet chamber 55 and the outlet passage 62 to the reservoir 34. Such a construction insures that even when the load pressure on the user is very small no undesired lifting of the user will occur.

In spite of varying loads applied on the user, especially due to the electrical nature of the control signals, the arrangement regulates the movement of the user so as to eliminate any undesirable oscillation of the latter.

Also it becomes possible in a relatively simple manner to provide a control arrangement wherein all the very strict requirements as to the firmness of such an arrangement are met. Besides that, by utilizing a single valve unit for controlling the movement of the user not only the firmness is improved, but also the expenses are considerable reduced, since the necessary relief valve unit simultaneously accomplishes the function of controlling the direction of the movement. Such a construction renders it possible to eliminate possible errors in the controlling operation, since the piston 16 is connected between the operating valve unit 15 and the reversing valve unit 12. It is also an advantageous feature of the present invention that it becomes possible to obtain prompt lowering of the user even if the load pressure is very small. Besides, no sero valve is required any longer for using in the respective valve seats.

It is to be understood that the present invention is by no means restricted to a magnetic-type of actuator as employed in the embodiment discussed above. The actuator can be any other type apart from magnetic. Also, instead of damping with the control plug in the reversing valve, a separate damping element can be used which is independent of the reversing piston. Other variants are possible within the gist of the present invention.

It will be understood that each of the elements described above, or two or more together, may also find a useful application in other types of a control arrangement for a hydraulic user, differing from the types described above.

While the invention has been illustrated and described as embodied in a control arrangement for a hydraulic user, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A control apparatus in combination with a hydraulic power consumer operable between a neutral position and a lifted position, particularly for a hydraulic working unit on a mobile agricultural machine, said apparatus comprising a pressure medium reservoir; means for supplying a pressure medium from said reservoir; check valve means having a pilot operated check valve member responsive to the backpressure from said consumer, to maintain said consumer in an adjusted position, and being preliminarily controlled by a pilot operated inlet and exhaust valve means; a reversing control valve having a spring biased control valve member movable at least between a neutral position and a lifting position, and defining two end faces, at least two control chambers adjoining respectively, the end faces of said control valve member, an inlet chamber connected between said check valve and said supplying means, a neutral pressure outlet chamber communicating with said reservoir and an additional chamber communicating with a control chamber and said outlet chamber; a fine control section provided on said control valve member for finely regulating the passage between said inlet and neutral pressure chambers; preliminary control valve means connected between said control valve and said check valve and being operable between a closed position and an open position in which the pressure medium from said inlet and outlet chambers is admitted into one of said control chambers to displace said control valve member from said neutral position into said lifting position when operated, said preliminary control valve means further controlling said pilot operated inlet and exhaust valve means; pressure responsive means for damping the movement of said control valve member, said pressure responsive means including a first control conduit connected via a throttle between the other control chamber and said pressure medium supplying means, a second control conduit connected between said first control conduit and said additional chamber, and a flow regulating and damping valve member for controlling said first control conduit when said control valve member is moved from said neutral position into said lifting position, said flow regulating member including a communication means formed in said control valve member and a control plug arranged for movement in said communication means between said first and second control conduit, and being acted upon on one side by pressure medium in said other control chamber and being biased from the other side by a pressure spring and by pressure medium in said second control conduit to progressively slow down the movement of said control valve member and to eliminate pressure oscillations resulting in said consumer.

2. An apparatus as defined in claim 1 wherein said communicating means constitute a first passage having one end open at said other control chamber and another end, a second passage having a leading end communicated with said another end of said first passage and a trailing end open at said communicating chamber.

3. An apparatus as defined in claim 2, wherein said control plug has an elongated body having a leading end portion movably received in said first passage and a trailing end portion axially spaced from said leading end portion, said leading end portion having a cross section substantially less than that of said first passage to thereby permit said pressure medium flow from said other control chamber into said communicating chamber, said leading end portion having a projection operative to regulate said pressure medium flow through said passage in response to displacing said control valve member toward said other control chamber and having a cross-section exceeding that of said first passage to thereby eventually close said passage on displacement of said control valve member toward said other control chamber.

4. An apparatus as defined in claim 3, said communication means further comprising an intermediate chamber provided in said control valve and operatively connected with said communicating chamber, said intermediate chamber being connected with said second control conduit.

5. An apparatus as defined in claim 4, wherein said control valve is further provided with a second intermediate chamber adjacent to and communicated with said inlet chamber; said pilot operated inlet and exhaust valve means having a second inlet chamber, a third intermediate chamber adjacent to said second inlet chamber, conduit means connecting said second intermediate chamber with said second inlet chamber, said second inlet chamber communicating with said third intermediate chamber when said consumer is immovable in said opposite direction and discommunicating when said consumer moves in said opposite direction.

6. An apparatus as defined in claim 5 wherein said check valve means is further provided with a second communicating chamber adjacent to and communicating with said third control chamber.

7. An apparatus as defined in claim 6, wherein said check valve means further comprise a fifth control chamber and a sixth control chamber axially spaced from said fifth control chamber; said check valve member being slidably mounted for movement between said fifth and said sixth control chambers in response to displacing said consumer.

8. An apparatus as defined in claim 7, wherein a third communicating chamber is provided between said fifth and said sixth control chambers.

9. An apparatus as defined in claim 7, wherein said check valve means is further provided with a valve seat, said check valve member movable in said housing between an open position to thereby communicate said sixth control chamber and said third communicating chamber in response to displacing said consumer and a closed position to thereby discommunicate said sixth control chamber from said third communicating chamber when said consumer is in said stationary neutral position.

10. An apparatus as defined in claim 9 further comprising resilient means operative for urging said check valve member into said closed position.

11. An apparatus as defined in claim 10, wherein said check valve member is provided with a throughgoing longitudinal passage connecting said fifth control chamber to said sixth control chamber and operative to permit said pressure medium flow at least temporarily from said sixth control chamber into said fifth control chamber when said consumer moves in said one direction, and from said fifth control chamber into said sixth control chamber when said consumer moves in said opposite direction.

12. An apparatus as defined in claim 11, further comprising means for regulating said pressure medium flow between said fifth and sixth control chambers to thereby prevent immediate flow of said pressure medium between said fifth control and said third communicating chambers when said consumer moves from said stationary position, said regulating means comprise a first valve seat provided on an internal wall of said check valve member, a second valve seat provided on said internal wall and axially spaced from said first seat and a ball movably mounted in said passage for relative movement between said two seats to thereby permit communication between said fifth and sixth control chambers when said ball is between said first and said second valve seat respectively.

13. An apparatus as defined in claim 12, further comprising means for displacing said ball from said first seat towards said second seat when said consumer moves in said opposite direction.

14. An apparatus as defined in claim 13, wherein said displacing means include a rod connected to said second piston in said pilot valve and having a portion projected out from said third control chamber and into said sixth control chamber, said portion having an end portion adapted to be received in said longitudinal passage of said valve member, so that when said second piston moves toward said third control chamber said end portion engaging said ball and urging the latter from said first seat toward said second seat.

15. An apparatus as defined in claim 14 wherein said longitudinal passage at least in the portion thereof which receives said end portion of said rod has a cross-sectional dimension exceeding that of said end portion, to thereby permit said pressure medium flow through said passage.

16. The apparatus as defined in claim 1, wherein said control valve member is formed with means for establishing communication between the other side of said control plug and said neutral pressure outlet chamber.

* * * * *